US011002071B2

(12) United States Patent
Campagna et al.

(10) Patent No.: US 11,002,071 B2
(45) Date of Patent: May 11, 2021

(54) ARCHITECTURAL ROLLER SHADE HOUSING WITH ADJUSTABLE BATTERY COMPARTMENT

(71) Applicant: Crestron Electronics, Inc., Rockleigh, NJ (US)

(72) Inventors: Michael Campagna, Woodcliff Lake, NJ (US); Charles R. Derk, Jr., Park Ridge, NJ (US); Stan Wisniewski, Pompton Plains, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 304 days.

(21) Appl. No.: 16/250,164

(22) Filed: Jan. 17, 2019

(65) Prior Publication Data

US 2019/0301241 A1 Oct. 3, 2019

Related U.S. Application Data

(60) Provisional application No. 62/649,638, filed on Mar. 29, 2018.

(51) Int. Cl.
*E06B 9/42* (2006.01)
*E06B 9/72* (2006.01)

(52) U.S. Cl.
CPC . *E06B 9/42* (2013.01); *E06B 9/72* (2013.01)

(58) Field of Classification Search
CPC ..... E06B 9/42; E06B 9/70; E06B 9/72; E06B 9/17007; E06B 9/17015; E06B 9/17023
USPC ..... 160/310, 311
See application file for complete search history.

(56) References Cited

U.S. PATENT DOCUMENTS

| | | | |
|---|---|---|---|
| 4,644,990 | A | 2/1987 | Webb, Sr. et al. |
| 4,951,730 | A | 8/1990 | Hsu |
| 5,274,499 | A | 12/1993 | Shopp |
| 5,603,371 | A | 2/1997 | Gregg |
| 5,698,958 | A | 12/1997 | Domel et al. |
| 5,793,174 | A | 8/1998 | Kovach et al. |
| 5,883,480 | A | 3/1999 | Domel et al. |
| 5,990,646 | A | 11/1999 | Kovach et al. |

(Continued)

*Primary Examiner* — Beth A Stephan
(74) *Attorney, Agent, or Firm* — Crestron Electronics, Inc.

(57) ABSTRACT

A battery operated shade is provided adapted to adjustably cover a structural opening. The shade generally comprises a shade material extending from a top end to a bottom end and a motor drive unit operably connected to the top end of the shade material and adapted to raise and lower the shade material between an upper limit and a lower limit to adjustably cover and uncover the structural opening. The shade also comprises a shade housing adapted to at least partially conceal the motor drive unit, wherein the shade housing defines a bottom opening at a bottom of the shade housing from which the shade material exits the shade housing. The shade further comprises a battery compartment adapted to removably retain batteries for providing power to the motor drive unit. The battery compartment is attached to the shade housing proximate to the bottom opening below the motor drive unit. The battery compartment is adapted to swivel from a first position where the battery compartment is at least partially concealed by the shade housing, through the bottom opening, and to a second position where the battery compartment is positioned out of the shade housing.

20 Claims, 7 Drawing Sheets

(56) References Cited

U.S. PATENT DOCUMENTS

| | | | | |
|---|---|---|---|---|
| 6,060,852 | A | 5/2000 | Domel et al. | |
| 6,371,192 | B1 | 4/2002 | Anderson et al. | |
| 6,382,294 | B1 | 5/2002 | Anderson et al. | |
| 6,446,693 | B1 | 9/2002 | Anderson et al. | |
| 6,516,858 | B1 | 2/2003 | Anderson et al. | |
| 6,533,018 | B2 | 3/2003 | Anderson et al. | |
| 6,688,368 | B2 | 2/2004 | Kovach et al. | |
| 6,736,186 | B2 | 5/2004 | Anderson et al. | |
| 7,783,277 | B2 | 8/2010 | Walker et al. | |
| 7,860,481 | B2 | 12/2010 | Walker et al. | |
| 8,299,734 | B2 | 10/2012 | Mullet et al. | |
| 8,368,328 | B2 | 2/2013 | Mullet et al. | |
| 8,371,358 | B1 | 2/2013 | Mullet et al. | |
| 8,540,005 | B2 | 9/2013 | Baugh et al. | |
| 8,575,872 | B2 | 11/2013 | Mullet et al. | |
| 8,659,246 | B2 | 2/2014 | Mullet et al. | |
| 8,723,455 | B2 | 5/2014 | Mullet et al. | |
| 8,791,658 | B2 | 7/2014 | Mullet et al. | |
| 8,851,141 | B2 | 10/2014 | Blair et al. | |
| 8,919,419 | B2 | 12/2014 | Mullet et al. | |
| 8,947,027 | B2 | 2/2015 | Mullet et al. | |
| 8,950,461 | B2 | 2/2015 | Adams et al. | |
| 8,968,900 | B2 | 3/2015 | Mullet et al. | |
| 9,018,868 | B2 | 4/2015 | Lucas et al. | |
| 9,045,939 | B2 | 6/2015 | Blair et al. | |
| 9,103,157 | B2 | 8/2015 | Mullet et al. | |
| 9,115,537 | B2 | 8/2015 | Blair | |
| 9,152,032 | B2 | 10/2015 | Mullet et al. | |
| 9,194,179 | B2 | 11/2015 | Mullet et al. | |
| 9,249,623 | B2 | 2/2016 | Mullet et al. | |
| 9,249,624 | B2 | 2/2016 | Blair et al. | |
| 9,376,862 | B2 | 6/2016 | Mullet et al. | |
| 9,376,863 | B2 | 6/2016 | Mullet et al. | |
| 9,394,743 | B2 | 7/2016 | Mullet et al. | |
| 9,410,369 | B2 | 8/2016 | Mullet et al. | |
| 9,447,636 | B2 | 9/2016 | Blair et al. | |
| 9,488,000 | B2 | 11/2016 | Kirby et al. | |
| 9,605,478 | B2 | 3/2017 | Adams et al. | |
| 9,611,690 | B2 | 4/2017 | Mullet et al. | |
| 9,725,948 | B2 | 8/2017 | Mullet et al. | |
| 9,725,952 | B2 | 8/2017 | Mullet et al. | |
| 9,745,796 | B2 | 8/2017 | Blair et al. | |
| 9,745,797 | B2 | 8/2017 | Mullet et al. | |
| 9,771,755 | B2 | 9/2017 | Mullet et al. | |
| 10,094,169 | B2 * | 10/2018 | Kirby | E06B 9/42 |
| 2003/0145956 | A1 | 8/2003 | Domel et al. | |
| 2003/0145957 | A1 | 8/2003 | Domel et al. | |
| 2003/0168187 | A1 * | 9/2003 | Wen | E06B 9/32 160/168.1 P |
| 2012/0090797 | A1 * | 4/2012 | Mullet | E06B 9/322 160/331 |
| 2012/0261079 | A1 | 10/2012 | Chambers et al. | |
| 2012/0281606 | A1 | 11/2012 | Cooney et al. | |
| 2013/0098561 | A1 * | 4/2013 | Mullet | E06B 9/42 160/29 |
| 2013/0153162 | A1 * | 6/2013 | Blair | B23P 6/00 160/310 |
| 2014/0014281 | A1 | 1/2014 | Mullet et al. | |
| 2014/0231032 | A1 * | 8/2014 | Blair | E06B 9/68 160/310 |
| 2014/0305602 | A1 * | 10/2014 | Kirby | E06B 9/42 160/310 |
| 2015/0075732 | A1 | 3/2015 | Kirby et al. | |
| 2015/0226001 | A1 | 8/2015 | Adams et al. | |
| 2015/0247362 | A1 * | 9/2015 | Kirby | E06B 9/42 160/310 |
| 2016/0108665 | A1 | 4/2016 | Blair et al. | |
| 2016/0123076 | A1 | 5/2016 | Kirby | |
| 2016/0362932 | A1 | 12/2016 | Blair et al. | |
| 2017/0044824 | A1 | 2/2017 | Kirby et al. | |
| 2017/0183909 | A1 | 6/2017 | Kirby et al. | |

* cited by examiner

ARCHITECTURAL ROLLER SHADE HOUSING WITH ADJUSTABLE BATTERY COMPARTMENT

BACKGROUND OF THE INVENTION

Technical Field

Aspects of the embodiments generally relate to battery operated roller shades, and more particularly to an architectural roller shade housing with adjustable battery compartment.

Background Art

Motorized roller shades provide a convenient one-touch control solution for screening windows, doors, or the like, to achieve privacy and thermal effects. A motorized roller shade typically includes a rectangular shade material attached at one end to a cylindrical rotating tube, called a roller tube, and at an opposite end to a hem bar. The shade material is wrapped around the roller tube. An electric motor, either mounted inside the roller tube or externally coupled to the roller tube, rotates the roller tube to unravel the shade material to cover a window.

Motorized roller shades require local power to be provided to the shade to energize the motor and associated electronics, such as the radio, control circuitry, and encoders, among other devices. Power is typically supplied using power over Ethernet (PoE) wiring, or a local power supply, such as a 24V wall-wart, which may be unsightly and/or challenging to install. In many installations, it may be difficult or impossible to run power and communication wires to a specific location especially in retrofit applications. Battery powered roller shades with radio transceivers for communication provide means to easily install and control a roller shade without running new wires. To enable operation of a roller shade for a prolonged amount of time, many large batteries are required, which present a challenge since they are needed to be stored in proximity to the roller tube in a hidden position. Roller shades typically house the batteries inside the roller tube or roller shade housing out of site from the end user. However, battery replacement in such roller shades is a cumbersome and difficult exercise.

Therefore, a need has arisen for systems, methods, and modes for an improved architectural roller shade housing with adjustable battery compartment that is easily accessible by the user.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a battery operated roller shade that will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to one aspect of the embodiments, a battery operated shade is provided adapted to adjustably cover a structural opening. The shade comprises a shade material extending from a top end to a bottom end and a motor drive unit operably connected to the top end of the shade material and adapted to raise and lower the shade material between an upper limit and a lower limit to adjustably cover and uncover the structural opening. The shade also comprises a shade housing adapted to at least partially conceal the motor drive unit, wherein the shade housing defines a bottom opening at a bottom of the shade housing from which the shade material exits the shade housing. The shade further comprises a battery compartment adapted to removably retain batteries for providing power to the motor drive unit. The battery compartment is attached to the shade housing proximate to the bottom opening below the motor drive unit. The battery compartment is adapted to swivel from a first position where the battery compartment is at least partially concealed by the shade housing, through the bottom opening, and to a second position where the battery compartment is positioned out of the shade housing.

According to an embodiment, the shade housing comprises a first housing portion adapted to retain the motor drive unit and a second housing portion adapted to retain the battery compartment below the motor drive unit. According to another embodiment, the shade housing comprises a front wall connected to a bottom wall that defines the bottom opening.

According to an embodiment, the battery compartment comprises a longitudinal body extending from a first end to a second end. The battery compartment may comprise a battery opening proximate to the second end that traversely extends through a side surface of the longitudinal body. The battery compartment may further comprise a door adapted to translate from a closed position where it closes the battery opening to an opened position where it exposes the battery opening. According to an embodiment, when the battery compartment is at the first position the door is at least partially concealed by the shade housing and is inaccessible, and when the battery compartment is at the second position the door is accessible and positioned outside the shade housing. According to a further embodiment, when the battery compartment is at the first position the door substantially faces a rear of the battery operated shade, and when the battery compartment is at the second position the door substantially faces a front of the battery operated shade. According to another embodiment, the door is biased in a closed position such that after being translated to an opened position and let go, the door closes to the closed position.

According to an embodiment, the battery operated shade further comprising a pair of swing arms each extending from a proximal end to a distal end and each pivotally connected at its proximate end to the shade housing. The pair of swing arms may be adapted to retain the first and second ends of the battery compartment body, wherein the pair of swing arms are adapted to pivot with respect to the shade housing to swivel the battery compartment from the first position to the second position. According to an embodiment, when the battery compartment is at the first position, the distal ends of the pair of swing arms are swiveled in and positioned within the shade housing, and wherein when the battery compartment is at the second position, the distal ends of the pair of swing arms are swiveled out and positioned outside the shade housing.

According to another embodiment, each of the first and second ends of the battery compartment are adapted to slide along the respective swing arm from its proximate end to its distal end. According to an embodiment, each swing arm comprises a longitudinal channel extending from about its proximal end to about its distal end, wherein each of the first end and the second end of the battery compartment comprises a nipple adapted to slide within the longitudinal channel in a respective swing arm. According to an embodiment, when the swing arms and thereby the battery compartment are in the first position, the first and second ends of the battery compartment are positioned proximate to the proximal ends of the swing arms; and wherein when the swing arms and thereby the battery compartment are in the second position, the first and second ends of the battery compartment are positioned proximate to the distal ends of the swing arms.

According to another embodiment, the motor drive unit is adapted to determine whether power of the batteries in the battery compartment are below a minimum battery threshold and when determining that the battery power is below the minimum battery threshold to move the shade material to a battery replacement position. According to an embodiment, the battery replacement position comprises a position where the shade material is substantially at but below the upper limit such that the bottom end of the shade material is positioned at a predetermined distance below the bottom opening of the shade housing. According to an embodiment, the minimum battery threshold corresponds to a minimum runtime required to raise the shade material from the lower limit to the battery replacement position. According to an embodiment, after moving the shade material to the battery replacement position, the motor drive unit is adapted to disable movement of the shade material until the batteries are replaced. According to another embodiment, the battery operated shade further comprises a locking mechanism adapted to maintain the battery compartment retained in the first position, wherein the motor drive unit is further adapted to release the locking mechanism after moving the shade material to the battery replacement position such that the battery compartment can swivel to the second position.

According to another embodiment, the battery operated shade further comprises a release latch adapted retain the battery compartment in the first position, wherein the release latch is adapted to be engaged to release the battery compartment such that it can swivel to the second position.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWINGS

Figure 1:
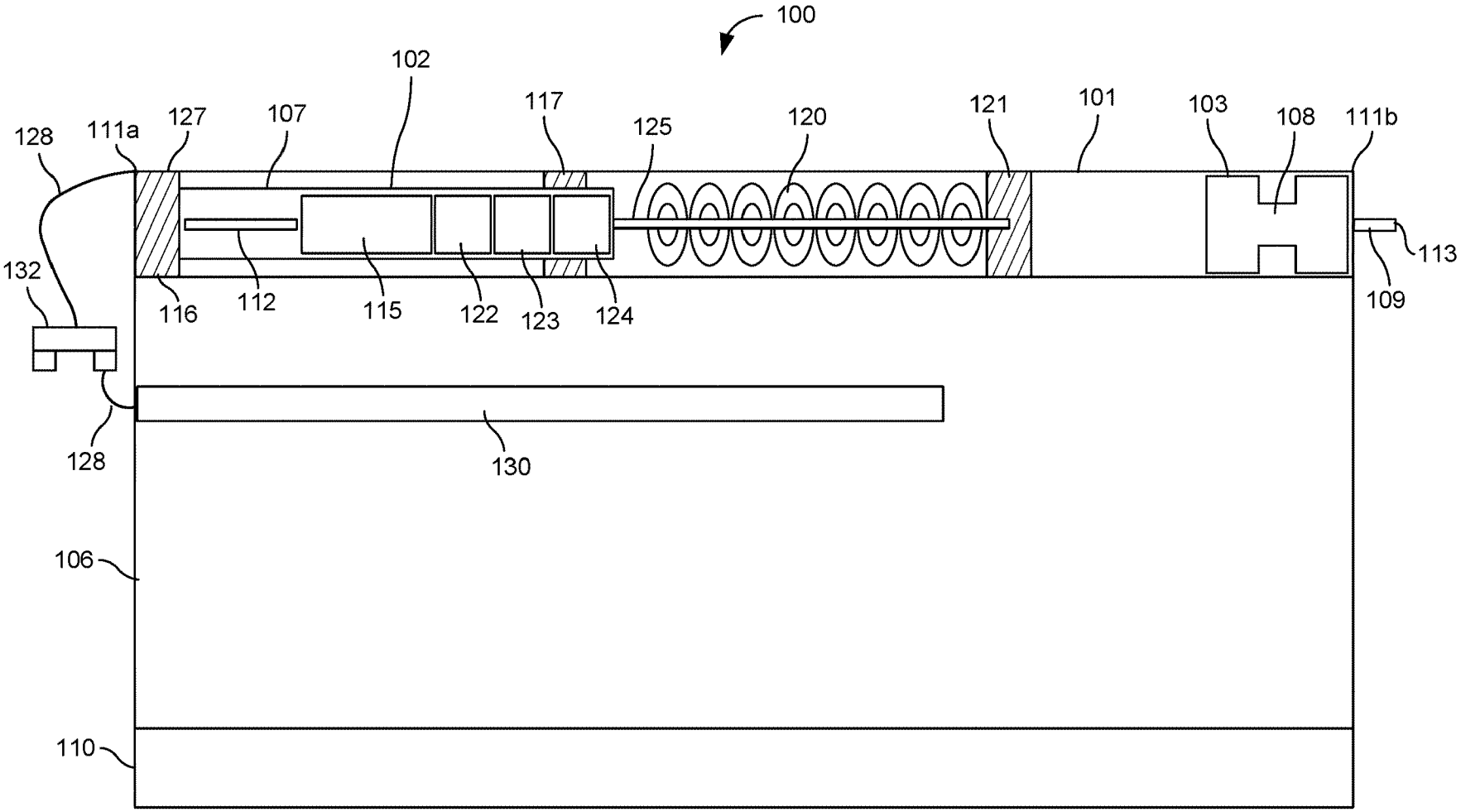

FIG. 1 illustrates a diagram of a battery operated shade according to an illustrative embodiment.

Figure 2:
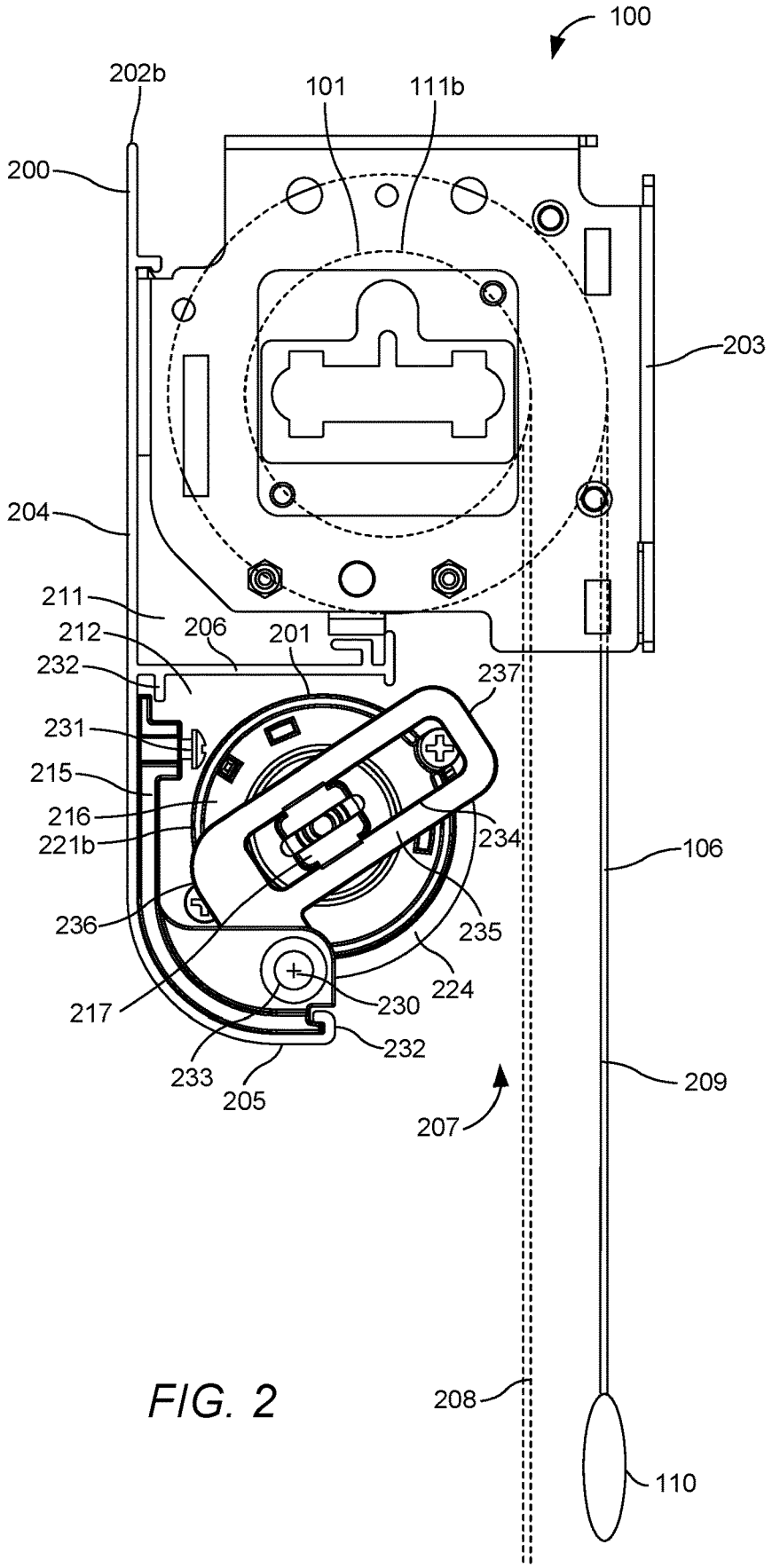

FIG. 2 illustrates a side view of the battery operated roller shade with a battery compartment in a hidden position within the roller shade housing according to an illustrative embodiment.

Figure 3:
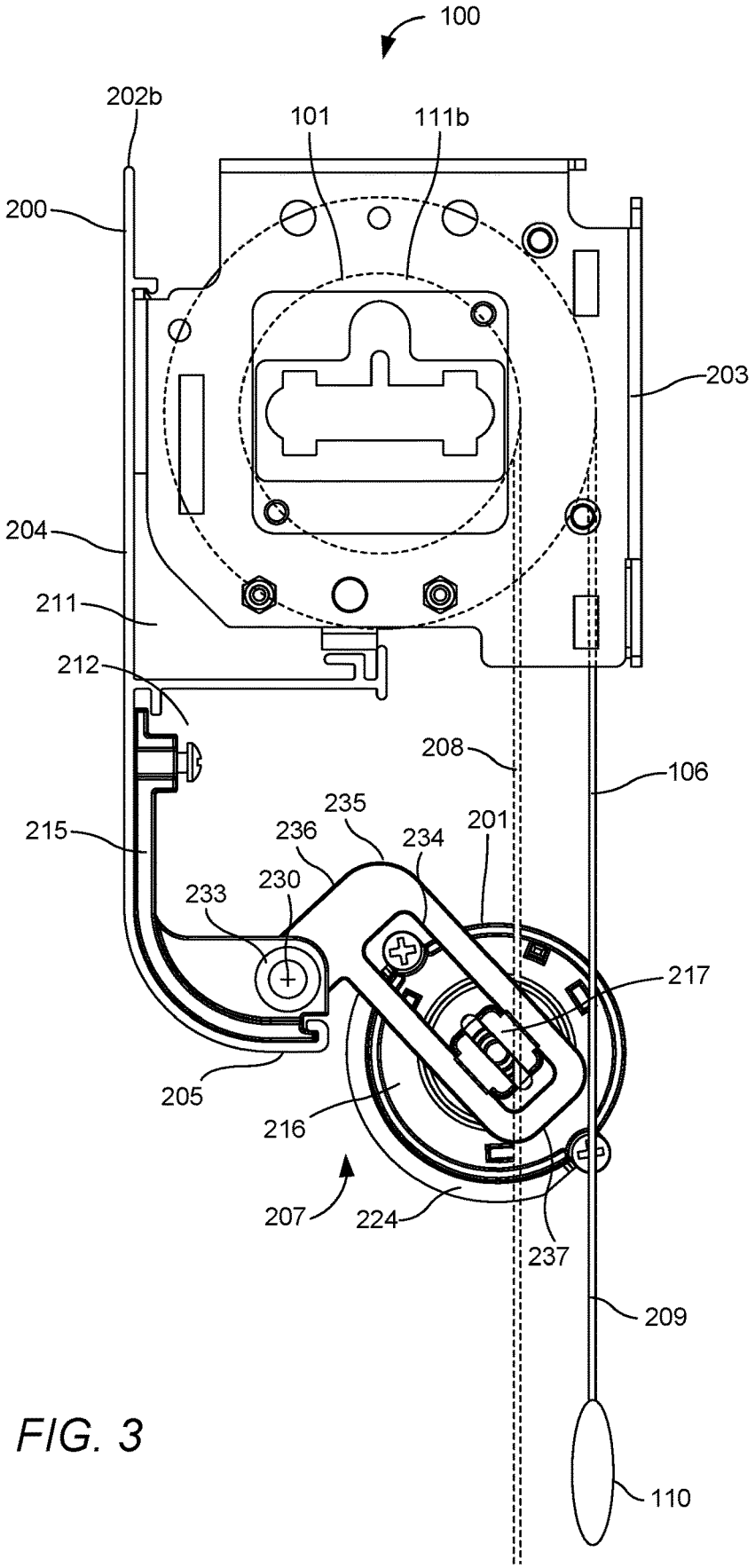

FIG. 3 illustrates a side view of the roller shade with the battery compartment in a partially extended position with respect to the roller shade housing according to an illustrative embodiment.

Figure 4:
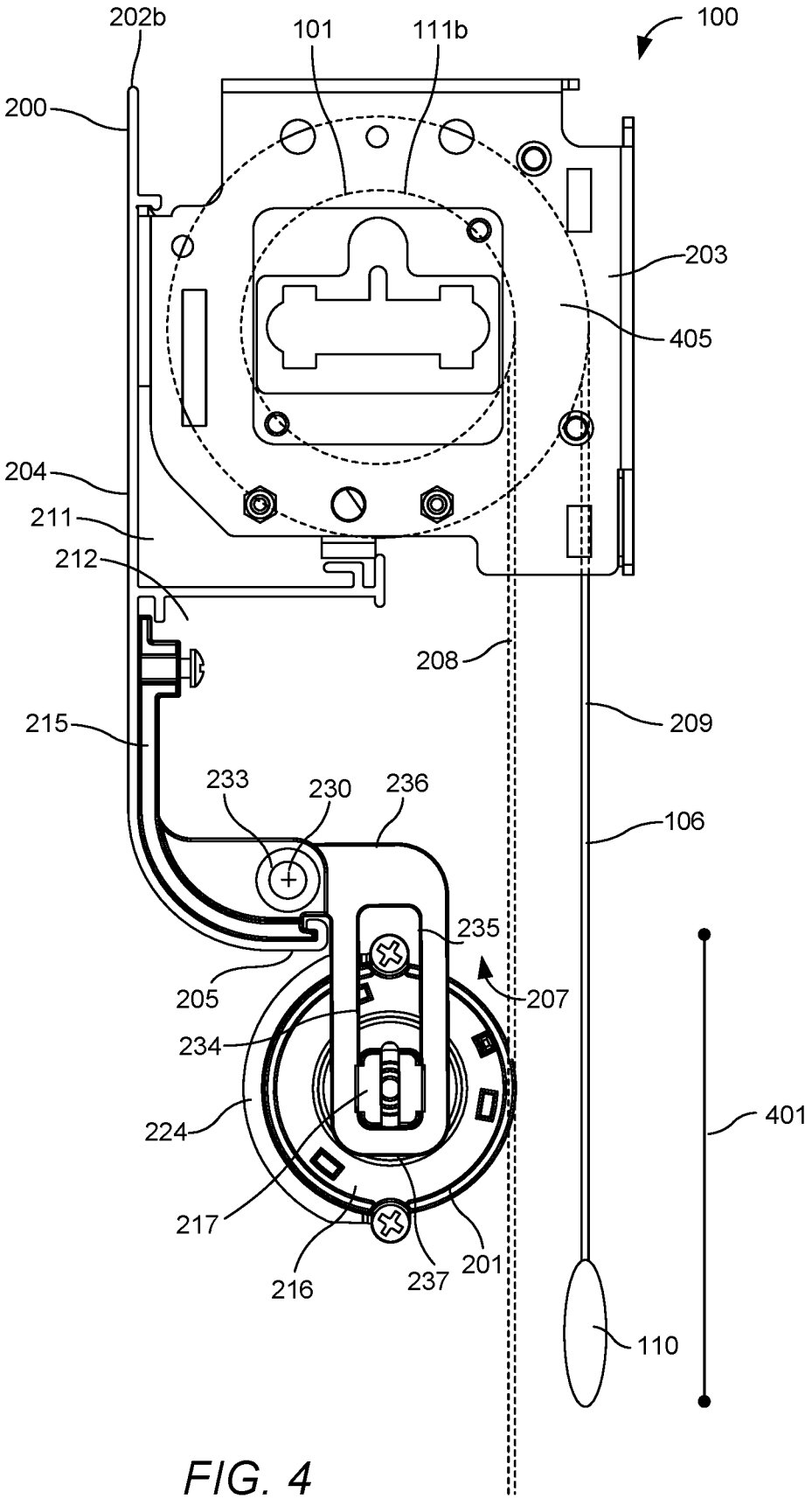

FIG. 4 illustrates a side view of the roller shade with the battery compartment in a fully extended position with respect to the roller shade housing according to an illustrative embodiment.

Figure 5:
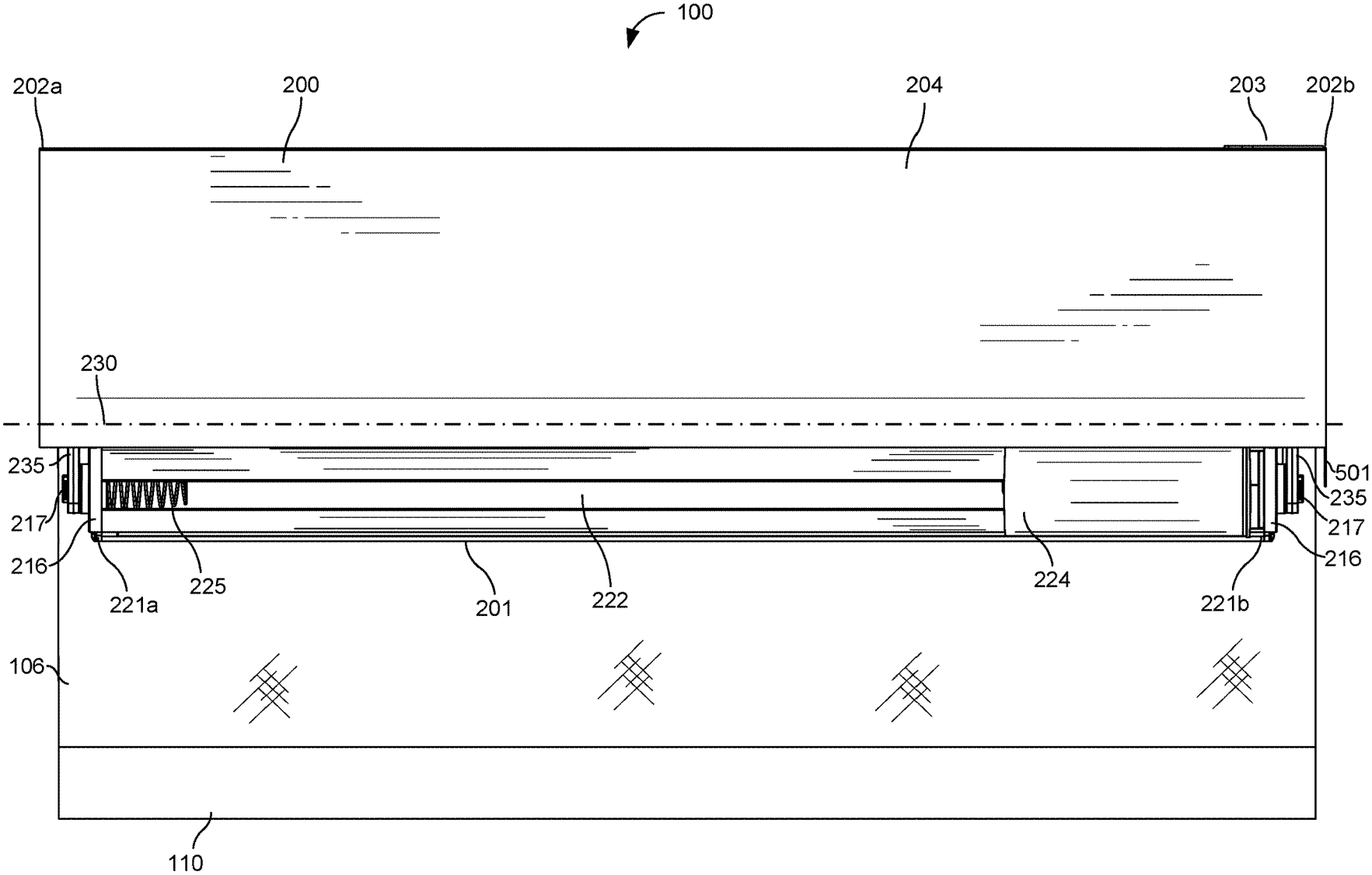

FIG. 5 illustrates a front view of the roller shade with the battery compartment in an extended position and with its door closed according to an illustrative embodiment.

Figure 6:
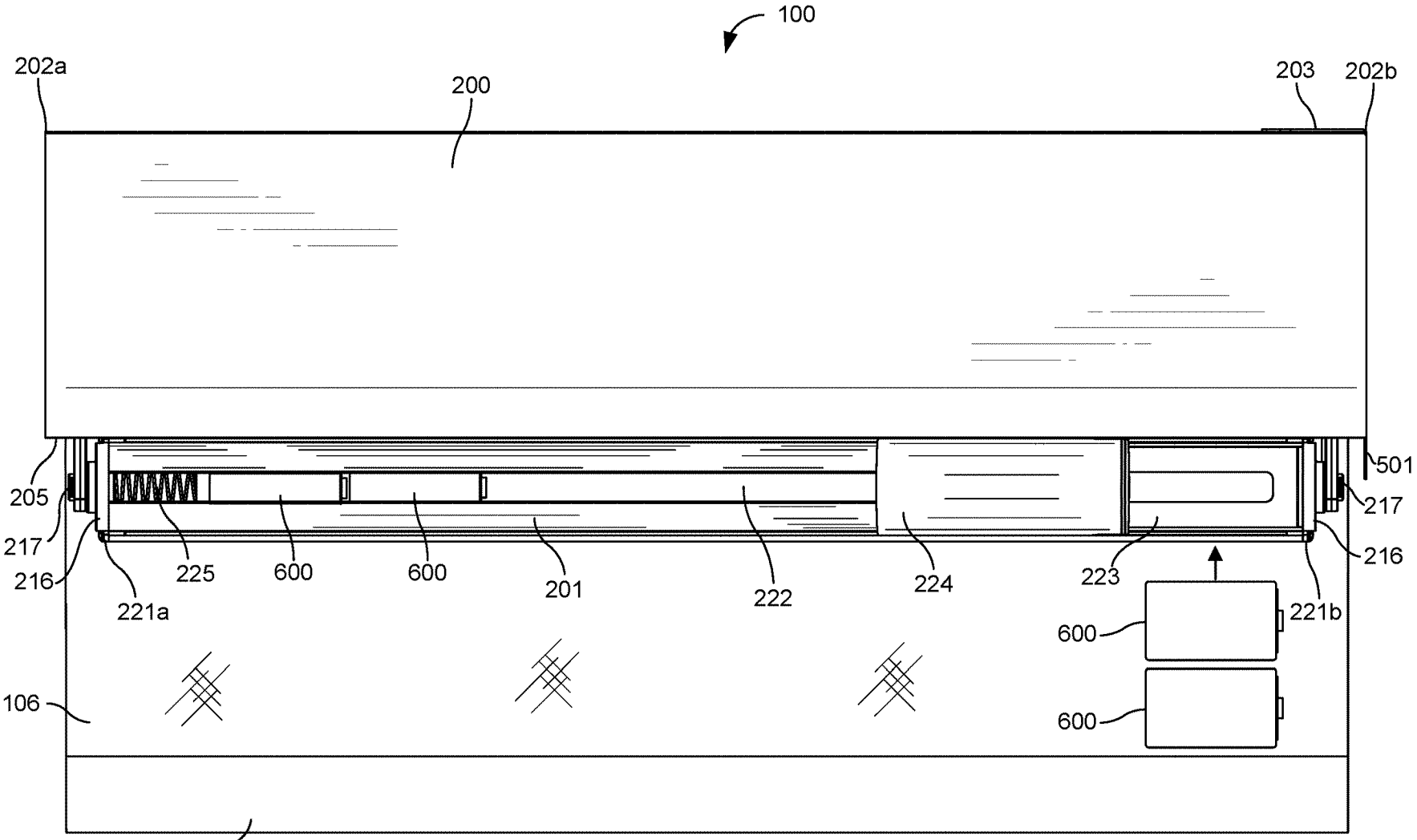

FIG. 6 illustrates a front view of the roller shade with the battery compartment in an extended position and with its door opened according to an illustrative embodiment.

Figure 7:
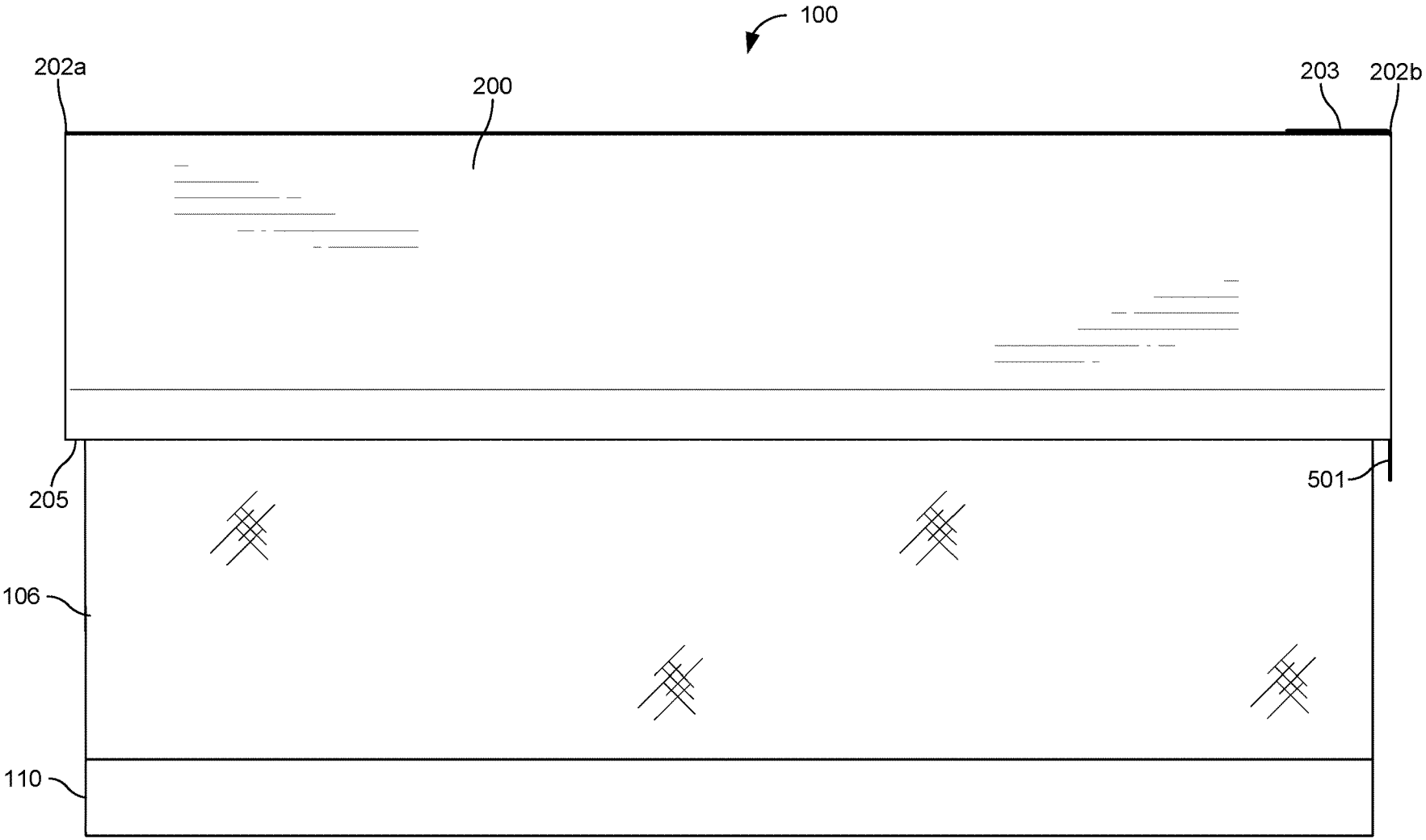

FIG. 7 illustrates a front view of the roller shade with the battery compartments in a hidden position according to an illustrative embodiment.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

List of Reference Numbers for the Elements in the Drawings in Numerical Order The following is a list of the major elements in the drawings in numerical order.

100 Roller Shade
101 Roller Tube
102 Motor Drive Unit
103 Idler Assembly
106 Shade Material

107 Motor Housing
108 Idler Body
109 Idler Pin
110 Hem Bar
111*a* First End of Roller Tube
111*b* Second End of Roller Tube
112 Motor Control Module
113 Pin Tip
115 Motor
116 Crown Adapter Wheel
117 Idler Crown Wheel
120 Counterbalancing Spring
121 Drive Wheel
122 First Stage Planetary Gear
123 Clutch
124 Final Stage Planetary Gear
125 Output Mandrel
127 Motor Head
128 Power Cord
130 Power Supply
132 Connectivity Port(s)
200 Roller Shade Housing
201 Battery Compartment
202*a* First End of Roller Shade Housing
202*b* Second End of Roller Shade Housing
203 Mounting Bracket(s)
204 Front Wall
205 Bottom Wall
206 Intermediate Horizontal Wall
207 Opening
208 First Drop Down Position Where Shade Material Substantially Fully Lowered
209 Second Drop Down Position Where Shade Material Substantially Raised
211 First Housing Portion
212 Second Housing Portion
215 Battery Compartment Supporting Bracket(s)
216 End Cap(s)
217 Nipple(s)
221*a* First End of Battery Compartment
221*b* Second End of Battery Compartment
222 Channel
223 Battery Opening
224 Door
225 Biasing Spring
230 Pivot Axis
231 Screw
232 Shoulder(s)
233 Rivet/Screw
234 Channel
235 Swing Arm(s)
236 Proximal End
237 Distal End
401 Distance
405 Layers
501 Release Latch
600 Battery(s)

List of Acronyms Used in the Specification in Alphabetical Order

The following is a list of the acronyms used in the specification in alphabetical order.

ASICs Application Specific Integrated Circuits
BLDC Brushless Direct Current
DC Direct Current
IR Infrared
LED Light Emitting Diode
PCB Printed Circuit Board
PoE Power Over Ethernet
RAM Random-Access Memory
RF Radio Frequency
ROM Read-Only Memory Mode(s) for Carrying Out the Invention For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamline technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The different aspects of the embodiments described herein pertain to the context of battery operated shades, but is not limited thereto, except as may be set forth expressly in the appended claims. While the roller shade is described herein for covering a window, the roller shade may be used to cover doors, wall openings, or the like. The embodiments described herein may further be adapted in other types of window or door coverings. For example, the battery compartment described herein may be placed in a shade housing designed to house an inverted roller, a Roman shade, an Austrian shade, a pleated shade, a blind type shade, a shutter type shade, a skylight shade, a garage door, or the like.

Disclosed herein are systems, methods, and modes for a battery operated roller shade, and more particularly to an architectural roller shade housing with adjustable battery compartment. Referring to FIG. 1, there is shown a diagram of a battery operated roller shade 100 according to one aspect of the embodiments. Roller shade 100 generally comprises a roller tube 101, a motor drive unit 102, an idler assembly 103, shade material 106, and a hem bar 110. Shade material 106 is connected at its top end to the roller tube 101 and at its bottom end to the hem bar 110. The motor drive unit 102 is adapted to raise or lower the shade material 106 to adjustably cover or uncover a structural opening, such as a window, a door, a wall opening, or the like. For example, in a roller shade application, shade material 106 wraps around the roller tube 101 and is wrapper or unwrapped from the roller tube 101 by rotation of the roller tube 101 by the motor drive unit 102. In various embodiments, the shade material 106 comprises fabric, plastic, vinyl, or other materials known to those skilled in the art.

Roller tube 101 is generally cylindrical in shape and longitudinally extends from a first end 111*a* to a second end 111*b*. In various embodiments, the roller tube 101 comprises aluminum, stainless steel, plastic, fiberglass, or other materials known to those skilled in the art. The first end 111*a* of the roller tube 101 may receive the motor drive unit 102 and the second end 111*b* of the roller tube 101 may receive the idler assembly 103, although the placement of the motor drive unit 102 and the idler assembly 103 may be reversed.

The idler assembly 103 of the roller shade 100 may comprise an idler pin 109 and an idler body 108 inserted into the second end 111*b* of the roller tube 101. The idler body 108 may be rotatably connected about the idler pin 109. It is inserted into the roller tube 101 and is operably connected to the roller tube 101 such that rotation of the roller tube 101 also rotates the idler body 108. The idler body 108 may comprise ball bearings therein (not shown) allowing the idler body 108, and thereby the roller tube 101, rotate with respect to the idler pin 109.

During installation, the roller shade 100 is mounted on or in a window between a pair of mounting brackets 203 (FIG. 2). The idler pin 109 may include a pin tip 113 disposed on its terminal end to attach the roller shade 100 to one of the mounting brackets 203. The roller shade 100 may then be mounted to the other mounting bracket 203 by snapping the motor head 127 of the motor drive unit 102 to the mounting bracket 203 or coupling the motor drive unit 102 to the mounting bracket 203 using screws.

The motor drive unit 102 may comprise a motor head 127 including a crown adapter wheel 116, a motor housing 107 containing a motor control module 112 and motor 115 therein, an idler crown wheel 117, a counterbalancing spring 120, and a drive wheel 121. The motor drive unit 102 may be inserted into the roller tube 101 from the first end 111*a*. The crown adapter wheel 116, idle crown wheel 117, and drive wheel 121 may be generally cylindrical in shape and may comprise a plurality of channels extending circumferentially about their external surfaces that mate with complementary projections radially extending from an inner surface of roller tube 101 such that crown adapter wheel 116, idle crown wheel 117, drive wheel 121, and roller tube 101 rotate together during operation. The drive wheel 121 is operably connected to the motor output shaft of the motor 115 such that rotation of the motor output shaft also rotates the drive wheel 121. The crown adapter wheel 116 and idle wheel 117 may be rotatably attached at two opposite ends of the motor housing 107 via ball bearings to hold the motor 115 concentric to the roller tube 101.

The motor 115 may comprise a brushless direct current (BLDC) electric motor. In another embodiment, the motor 115 comprises a brushed direct current (DC) motor, or any other motor known in the art. In operation, the roller shade 100 is rolled down and rolled up via the motor drive unit 102. Particularly, the motor 115 drives the drive wheel 121, which in turn engages and rotates the roller tube 101. The roller tube 101, in turn, engages and rotates the crown adapter wheel 116, idle crown wheel 117, and idler body 108 with respect to the motor 115, while the motor housing 107, including the motor 115 and motor control module 112, remain stationary. The motor 115 may drive the drive wheel 121 through a series of components that in combination provide efficiency and counterbalancing to the roller shade 100, such as a first stage planetary gear 122, a clutch 123, a final stage planetary gear 124, an output mandrel 125, and a counterbalancing spring 120. In one embodiment, the first and final stage planetary gears 122 and 124 may be configured for providing speed reduction and torque increase to achieve efficient operation of the motor 115. According to another embodiment, the first and final stage planetary gears 122 and 124 may be configured for providing increased speed and decreased torque. The spring 120 may be pretensioned in the factory using the motor 115. The pretensioned counterbalancing spring 120 assists the motor 115 to roll up the shade material 106 throughout the rolling up cycle without the motor 115 requiring to exert much power. According to an embodiment, the battery powered roller shade 100 may comprise similar configuration to the battery power roller shade disclosed in U.S. patent application Ser. No. 15/872,467, filed Jan. 16, 2018, titled "Motor Pretensioned Roller Shade," the entire contents of which are hereby incorporated by reference.

The motor control module 112 operates to control the motor 115, directing the operation of the motor, including its direction, speed, and position. The motor control module 112 may comprise fully integrated electronics housed on a single or a plurality of printed circuit boards (PCBs). The motor control module 112 may comprise a controller, a memory, a communication interface, a user interface, and a light indicator. The user interface may comprise buttons, such as open and close, as well as a setup button that may allow the user to set the upper limit, the lower limit, the battery replacement limit (discussed below), reverse motor direction as well as assist in acquiring shades to the control system and any other intermediary devices necessary. The buttons may be arranged on the motor drive unit 102 such that they are visible from the front or bottom of the motor drive unit 102. The light indicator, such as a multicolor light emitting diode (LED), may be adapted to display device status, any error feedback, status blink codes, as well as the battery status, such as low-battery conditions. The controller can represent one or more microprocessors, and the microprocessors can be "general purpose" microprocessors, a combination of general and special purpose microprocessors, or application specific integrated circuits (ASICs). The controller provides processing capability for one or more of the techniques and functions described herein. The memory can be communicably coupled to controller and can store data and executable code. In another embodiment, memory is integrated into the controller. The memory can represent volatile memory such as random-access memory (RAM), but can also include nonvolatile memory, such as read-only memory (ROM) or Flash memory.

The communication interface may comprise a wireless communication interface configured for bidirectional communication with other electronic devices over a communications network. A wireless interface can comprise a radio frequency (RF) transceiver, an infrared (IR) transceiver, trace antenna, or other communication technologies known to those skilled in the art. The wireless interface may communicate using a communication protocol, such as the infiNET EX® protocol from Crestron Electronics, Inc. of Rockleigh, N.J., ZigBee® protocol from ZigBee Alliance, Bluetooth, or the like.

The control commands received by the motor control module 112 may be a direct user input to the controller from the user interface or a wireless signal from an external control point. For example, the motor control module 112 may receive a control command from a wall-mounted button panel or a touch-panel in response to a button actuation or similar action by the user. Control commands may also originate from a signal generator such as a timer or a sensor. Accordingly, the motor control module 102 can integrate seamlessly with other control systems using the communication interface to be operated from keypads, wireless remotes, touch screens, and wireless communication devices, such as smart phones. Additionally, the motor control module 102 can be integrated within a large scale building automation system or a small scale home automation system and be controllable by a central control processor, such as the PRO3 control processor available from Crestron Electronics, Inc., that networks, manages, and controls a building management system.

The motor drive unit 102 may be connected to a replaceable power supply 130, such as a plurality of serially arranged batteries. Power supply 130 provides power to the circuitry of the motor control module 112, and in turn the motor 115. The motor control module 112 may be connected to the power supply 130, such as batteries, through power cords 128 and one or more connectivity ports 132. In yet another embodiment, the motor control module 112 may also be connected to a solar panel or a solar collection module placed in proximity to the window to aggregate solar energy and recharge the batteries.

Referring to FIGS. 2-7, where FIG. 2 illustrates a side view of the battery operated roller shade 100 with the battery compartment 201 in a retracted or hidden position within the roller shade housing 200, FIG. 3 illustrates a side view of the roller shade 100 with the battery compartment 201 in a partially extended position with respect to the roller shade housing 200, FIG. 4 illustrates a side view of the roller shade 100 with the battery compartment 200 in a fully extended position; FIG. 5 illustrates a front view of the roller shade 100 with the battery compartment 201 in an extended position and with its door 224 closed, FIG. 6 illustrates a front view of the roller shade 100 with the battery compartment 201 in an extended position and with its door 224 opened, and FIG. 7 illustrates a front view of the roller shade 100 with the battery compartment 201 in a retracted or hidden position.

As seen in FIG. 2, each end of the roller shade 100 may be mounted to a mounting bracket 203. The mounting brackets can comprise similar configuration to the CSS-ARCH3 QMT3 Series Architectural Shade Hardware, available from Crestron Electronics, Inc. of Rockleigh, N.J. Other types of brackets may be utilized without departing from the scope of the present embodiments. The mounting bracket 203 in turn can be surface-mounted on a wall or ceiling or recess-mounted in a pocket or window jamb.

The roller shade 100 further comprises housing 200 which may comprise a first housing portion 211 a second housing portion 212. The first housing portion 211 may at least partially cover or conceal the roller tube 101 from view, including the motor drive unit 102 therein, as well as any of the shade material 106 wrapped around the roller tube 101. The second housing portion 212 may at least partially cover or conceal the battery compartment 201 from view when it is in a retracted position. According to an embodiment, as shown in FIG. 2, the housing 200 may consist of a decorative fascia comprising a front wall 204 that covers the front of the roller tube 101 as well as the battery compartment 201. The housing 200 may further comprise a bottom wall 205 that partially covers the bottom of the roller tube 101 as well as the battery compartment 201 from view. The housing 200 may further comprise an intermediate horizontal wall 206 extending from an inner surface of the front wall 204 to partially segregate the roller tube 101 and battery compartment 201. According to an embodiment, the bottom wall 205 may be partially curved resulting in a curved fascia, as shown in FIG. 2, or alternatively it may be flat resulting in a square fascia. According to a further embodiment, additional covers, such as top and back covers, and a blackout extrusion can be attached to the side mounting brackets 203 or the fascia's front wall 204 to provide additional coverage or blackout for the top and back of the roller tube 101. According to another embodiment, the housing 200 may instead comprise a pocketed construction consisting of a U-shaped extrusion that covers the front, top, and back of the roller tube 101. Alternatively, a G-shaped housing 200 may be used that also partially covers the bottom of the roller tube 101.

Irrespective of the housing type or shape, the housing 200 defines an opening 207 at the bottom that allows the shade material 106 to drop down from the roller tube 101 and out of the housing 200. The housing 200 may be connected to and supported by the pair of oppositely disposed mounting brackets 203, for example by having the fascia snap on the front of each of the mounting brackets 203. Although in other embodiment, the mounting brackets 203 and housing 200 may be an integral component. Referring to FIG. 5, the housing 200 may span the width of the roller tube 101 and may longitudinally extend from a first end 202*a* to a second end 202*b*. Referring back to FIG. 2, a battery compartment supporting bracket 215 may be connected at each end 202*a-b* of the housing 200, each adapted to support and rotatably connect the battery compartment 201 to the housing 200. The housing 200 may comprise a pair of shoulders 232 spaced to retain the battery compartment supporting brackets 215 therebetween. Each supporting bracket 215 may be further secured to the roller shade housing 200 using screw 231.

The battery compartment 201 may be secured to the housing 200 at a position below the roller tube 101 such that it does not impede with the travel of the shade material 106 and/or the hem bar 110 when the battery compartment 201 is in a retracted position. Particularly, when the shade material 106 is raised or lowered between its upper and lower limits, it tends to translate laterally with respect to the roller tube 101—for example from a first drop down position 208, where the shade material 106 is substantially fully lowered or fully unrolled from the roller tube 101 (i.e., at the lower limit), to a second drop down position 209, where the shade material 106 is substantially raised or substantially rolled on the roller tube 101 (i.e., at the upper limit). This is because as the shade material 106 rolls on the roller tube 101, the shade material 106 layers on the roller tube 101 causing the diameter of the shade material 106 on the roller tube 101 to increase and result in the lateral movement of the shade material 106. As such, the drop down position of the shade material 106 is continuously displaced. Accordingly, the battery compartment 201 is secured to the housing 200 at a retracted position shown in FIG. 2 at sufficient distance from the shade material 106 and hem bar 110 such that the battery compartment 201 does not contact the shade material 106 or the hem bar 110 whether it is fully raised or lowered during operation.

Referring to FIGS. 2 and 5, the battery compartment 201 may comprise a tubular body or enclosure designed to maintain a compact and discrete appearance that is easily accessible for battery replacement. Battery compartment 201 longitudinally extends from a first end 221*a* to a second end 221*b*, each attached to a respective battery compartment supporting bracket 215. The battery compartment 201 may be made from a lightweight material, such as plastic or a light weight metal extrusion, although other materials may be utilized. The battery compartment 201 may comprise a pair of end caps 216 adapted to close the first and second ends 221*a* and 221*b* of the battery compartment 201. Although according to an alternative embodiment, the battery compartment 201 may comprise a single tubular enclosure with integrated closed ends. The battery compartment 201 may be shaped and sized to receive a plurality of batteries arranged in series within the battery compartment 201, for example, eight Alkaline D' cell batteries 600 (FIG. 6). According to other embodiments, other battery number and sizes may be utilized, such as 'A', 'AA', 'C', or 'PP3' cells, or equivalent rechargeable options.

As shown in FIG. 6, the battery compartment 201 may comprise a battery opening 223 traversely extending through its side surface and adapted and sized to receive a battery 600 therethrough and into the battery compartment 201. The opening 223 may be disposed adjacent to a second end 221*b* (or the first end 221*a*) of the battery compartment 201. The battery compartment 201 may also comprise a channel 222 that traverses its surface and longitudinally extends from the first end 221*a* of the battery compartment 201 to the battery opening 223. The batteries 600 may be loaded one by one into the battery compartment 201 through the battery opening 223 at the second end 221*b* and may be slid towards the first end 221*a* by accessing the batteries 600 using the longitudinal channel 222 until the battery compartment 201 is full. The battery compartment 201 may comprise a biasing spring 225 adapted to bias and retain the batteries 600 within the battery compartment 201. The battery compartment 201 may further comprise a pair of contacts therein proximate to its first and second ends 221*a-b* that may be connected via power cord 128 to the motor control module 112 (FIG. 1) to provide contact and power to the batteries 600 therein.

The battery compartment 201 may further comprise a door 224 disposed over the battery opening 223. The door 224 may be adapted to slide from a closed position where it closes the battery opening 223, as shown in FIG. 5, to an opened position where it exposes the battery opening 223 permitting batteries 600 to be inserted therethrough. According to an embodiment, the door 224 may be biased using a spring to generally maintain the door 224 in a closed position (FIG. 5). As such, the door 224 may be slid by a user to an open position (FIG. 6) to insert the batteries 600, and may automatically slide to the closed position (FIG. 5) once it is let go via the biasing spring.

Referring to FIG. 2, each end cap 216 of the battery compartment 201 may comprise a nipple 217 laterally extending therefrom. Each battery supporting bracket 215 may further comprise an L-shaped swing arm 235 that may be pivotally secured at its proximate end 236 to the battery supporting bracket 215, and thereby with respect to the roller shade housing 200, using a rivet or a screw 233 about a pivot axis 230. Swing arm 235 may comprise a longitudinal channel 234 extending therethrough from in proximity to its proximal end 236 to in proximity to its distal end 237. Each nipple 217 on a respective end cap 216 is adapted to slide within and along a respective channel 234 within the swing arm 235.

During normal operation of the roller shade 100, the battery compartment 201 is maintained in the retracted position shown in FIGS. 2 and 7 where the battery compartment 201 is tucked in within the second housing portion 212 of the roller shade housing 200, and hidden by front wall 204 and at least partially by the bottom wall 205. In the retracted position, each swing arm 235 is positioned within the second housing portion 212 such that the channel 234 is oriented at about 45 degree angle with respect to the front wall 204 of the roller shade housing 200. In this position, the channel 234 is declined towards the proximal end 236 of the swing arm 235. The decline of channel 234 causes each nipple 217, and thereby the battery compartment 201, to be positioned within a respective channel 234 proximate to the proximal end 236 of the swing arm 235, and thereby tucked in proximate the front wall 204 of the roller shade housing 200 and away from the shade material 106 and hem bar 110.

According to an embodiment, the motor control module 112 may include battery status monitoring to help users in determining when the batteries 600 need replacement. The motor control module 112 may include circuitry to monitor the power of the batteries through power cord 128 (FIG. 1). With battery status monitoring, the motor control module 112 may send out alerts, letting customer providers and/or end users know when battery replacement is needed. For example, once the battery power reaches a minimum battery threshold, the motor control module 112 may inform the user that the batteries need to get changed, for example, using a native user interface on the motor drive unit 102 or an external user interface point. For example, the motor control module 112 may blink LED in a red color.

In addition, once determining that the battery power has reached the minimum battery threshold, or a second minimum battery threshold, the motor control module 112 may direct the shade material 106 to move to the preset battery replacement limit such that the hem bar 110 is located at a battery replacement position. For example, referring to FIG. 4, the battery replacement position may be a position where the hem bar 110 is positioned at a predetermined distance 401 below the opening 207 at the bottom end of the roller shade housing 200. At this battery replacement position shown in FIG. 4, the shade material 106 may be substantially, but not fully, raised or rolled up on the roller tube 101 (i.e., below the upper limit). As such, the shade material 106 is at a position that is somewhat below the fully-opened position. The layers 405 formed by the shade material 106 on the roller tube 101 cause the shade material 106 to hang at a drop down position 209 that is farther away from the battery compartment 201 than drop down position 208 when the shade material 106 is fully unraveled from the roller tube 101. Being farther away provides more space for the battery compartment 201 to swing down from the shade housing 200. In addition, at the battery replacement position shown in FIG. 4, the hem bar 110 is positioned at a sufficient distance 401 below the opening 207 such that it not in a way when the battery compartment 201 is swung down to an extended position shown in FIG. 4. According to an embodiment, the battery replacement position may be a factory preset limit, or a battery replacement limit preset by the installer. According to an embodiment, the minimum battery threshold may correspond to the minimum runtime required to raise the shade material 106 from a fully lowered or rolled down position (i.e., lower limit) to the battery replacement position shown in FIG. 4.

As such, if the hem bar 110 is positioned below the battery replacement position shown in FIG. 4 (for example when the roller shade 100 is fully closed or partially closed), and if the motor control module 112 detects that the battery power level is at or below the minimum battery threshold, the motor control module 112 may raise the shade material 106 until the hem bar 110 is position at the battery replacement position. Similarly, if the hem bar 110 is positioned above the battery replacement position shown in FIG. 4 (for example when the roller shade 100 is fully opened), and if the motor control module 112 detects that the battery power level is at or below the minimum battery threshold, the motor control module 112 may lower the shade material 106 until the hem bar 110 is position at the battery replacement position. The motor control module 112 may then disable the motor 115 from raising or lowering the shade material 106 until the batteries 600 are replaced. Meanwhile, the motor control module 112 may alert the user that batteries 600 need replacement, as discussed above.

To replace the batteries, each swing arm 235, and thereby the battery compartment 102, may swivel out of the second housing portion 212 about the pivot axis 230 and down through opening 207 in the roller shade housing 200 as shown in FIG. 3 to the extended position shown in FIG. 4. As such, the battery compartment 102 swings down to replace the batteries 600 without removing or moving the roller shade 100 or the roller shade housing or fascia 200. According to an embodiment, the battery compartment 200 may comprise a release latch or lever 501 that generally keeps the battery compartment 200 retained in the retracted position shown in FIGS. 2 and 7. The release latch 501 may release the battery compartment 200 when it is engaged by a user such that the battery compartment 200 swivels and drops down to the extended position shown in FIG. 4, for example via gravity.

According to another embodiment, the battery compartment 200 may be maintained in a retracted position shown in FIG. 2 via a locking mechanism, such as a magnetic lock. The magnetic lock may be operated using the motor control module 112. Once the battery power falls at or below the minimum battery threshold, the motor control module 112 may actuate the magnetic lock to release the battery compartment 200 such that it can drop to the extended position shown in FIG. 4. Although other types of locks or levers operable by the motor control module 112 may be alternatively utilized.

As the battery compartment 200 swings out via the swing arm 235, the channel 234 of the swing arm 235 translates from being declined towards the proximal end 236 of the swing arm 235 to being declined towards the distal end 237 of the swing arm 235. This causes the nipples 217 of endcaps 216 to slide along the channel 234 towards the distal end 237 of the swing arm 235 as shown in FIGS. 3 and 4. As such, in fully extended position shown in FIG. 4, each swing arm 235 is positioned outside the second housing portion 212 such that the respective channel 234 is oriented substantially parallel to the front wall 204 of the roller shade housing 200 and the battery compartment 200 hangs at the distal end 237 of the swing arm 235. The L-shaped swing arm 235 and the longitudinal channel 234 therein help to decrease the radius of rotation of the battery compartment 201 with respect to the roller shade housing 200 about pivot axis 230. This allows the roller shade housing 200 to maintain a small profile while allowing the battery compartment 201 to exit the opening 207 in the roller shade housing 200 and provide the necessary access to the batteries 600 in the compartment 201 in the extended position shown in FIGS. 4 and 5.

As shown in FIGS. 4 and 5, when the battery compartment 201 is swung down, door 224 faces the front of the roller shade 100. According to an embodiment, the biased door 224 will remain closed to prevent the batteries 600 from falling out of the battery compartment 201 during replacement. The user may then slide and open the door 224 to access the battery opening 223 and replace the batteries 600 as shown in FIG. 6. Once the batteries 600 are replaced, the user may release the door 224 to close the battery opening 223 and tilt the battery compartment 201 back into the second housing portion 212 behind the front wall 204 of the roller shade housing 200. The decline of channel 234 toward the proximal end 236 will cause each nipple 217, and thereby the battery compartment 201, to travel along the channel 234 to a positioned proximate to the proximal end 236 of the swing arm 235 and thereby proximate the front wall 204 of the roller shade housing 200. The motor control module 112 may then determine that the battery power has raised above the minimum battery threshold and reactivate the operation of the motor 115 to raise or lower the shade material 106.

Industrial Applicability

The disclosed embodiments provide a system, software, and a method for an improved architectural roller shade housing with adjustable battery compartment that is easily accessible by the user. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments.

What is claimed is:

1. A battery operated shade adapted to adjustably cover a structural opening comprising:

a shade material extending from a top end to a bottom end;

a motor drive unit operably connected to the top end of the shade material and adapted to raise and lower the shade material between an upper limit and a lower limit to adjustably cover and uncover the structural opening;

a shade housing adapted to at least partially conceal the motor drive unit, wherein the shade housing defines a bottom opening at a bottom of the shade housing from which the shade material exits the shade housing; and a battery compartment adapted to removably retain batteries for providing power to the motor drive unit, wherein the battery compartment is attached to the shade housing proximate to the bottom opening below the motor drive unit, wherein the battery compartment is adapted to swivel from a first position where the battery compartment is at least partially concealed by the shade housing, through the bottom opening, and to a second position where the battery compartment is positioned out of the shade housing.

2. The battery operated shade of claim 1, wherein the shade housing comprises a first housing portion adapted to retain the motor drive unit and a second housing portion adapted to retain the battery compartment below the motor drive unit.

3. The battery operated shade of claim 1, wherein the shade housing comprises a front wall connected to a bottom wall that defines the bottom opening.

4. The battery operated shade of claim 1, wherein the battery compartment comprises a longitudinal body extending from a first end to a second end.

5. The battery operated shade of claim 4, wherein the battery compartment comprises a battery opening proximate to the second end that traversely extends through a side surface of the longitudinal body.

6. The battery operated shade of claim 5, wherein the battery compartment comprises a door adapted to translate from a closed position where it closes the battery opening to an opened position where it exposes the battery opening.

7. The battery operated shade of claim 6, wherein when the battery compartment is at the first position the door is at least partially concealed by the shade housing and is inaccessible, and wherein when the battery compartment is at the second position the door is accessible and positioned outside the shade housing.

8. The battery operated shade of claim 6, wherein when the battery compartment is at the first position the door substantially faces a rear of the battery operated shade, and wherein when the battery compartment is at the second position the door substantially faces a front of the battery operated shade.

9. The battery operated shade of claim 6, wherein the door is biased in a closed position such that after being translated to an opened position and let go, the door closes to the closed position.

10. The battery operated shade of claim 4 further comprising a pair of swing arms each extending from a proximal end to a distal end, wherein the proximate end of each of the swing arms is pivotally connected to the shade housing, wherein the pair of swing arms are adapted to retain the first and second ends of the battery compartment body, wherein the pair of swing arms are adapted to pivot with respect to the shade housing to swivel the battery compartment from the first position to the second position.

11. The battery operated shade of claim 10, wherein when the battery compartment is at the first position, the distal ends of the pair of swing arms are swiveled in and positioned within the shade housing, and wherein when the battery compartment is at the second position, the distal ends of the pair of swing arms are swiveled out and positioned outside the shade housing.

12. The battery operated shade of claim 10, wherein each of the first and second ends of the battery compartment are adapted to slide along the respective swing arms from its proximate end to its distal end.

13. The battery operated shade of claim 12, wherein each of the swing arms comprises a longitudinal channel extending from about its proximal end to about its distal end, wherein each of the first end and the second end of the battery compartment comprises a nipple adapted to slide within the longitudinal channel in each of the swing arms.

14. The battery operated shade of claim 12, wherein when the swing arms and thereby the battery compartment are in the first position, the first and second ends of the battery compartment are positioned proximate to the proximal ends of the swing arms; and wherein when the swing arms and thereby the battery compartment are in the second position, the first and second ends of the battery compartment are positioned proximate to the distal ends of the swing arms.

15. The battery operated shade of claim 1, wherein the motor drive unit is adapted to determine whether power of the batteries in the battery compartment is below a minimum battery threshold and when determining that the battery power is below the minimum battery threshold to move the shade material to a battery replacement position.

16. The battery operated shade of claim 15, wherein the battery replacement position comprises a position where the bottom end of the shade material is positioned at a predetermined distance below the bottom opening of the shade housing.

17. The battery operated shade of claim 15, wherein the minimum battery threshold corresponds to a minimum runtime required to raise the shade material from the lower limit to the battery replacement position.

18. The battery operated shade of claim 15, wherein after moving the shade material to the battery replacement position, the motor drive unit disables movement of the shade material until the batteries are replaced.

19. The battery operated shade of claim 15 further comprising a locking mechanism adapted to maintain the battery compartment retained in the first position, wherein the motor drive unit is further adapted to release the locking mechanism after moving the shade material to the battery replacement position such that the battery compartment can swivel to the second position.

20. The battery operated shade of claim 1 further comprising a release latch adapted to retain the battery compartment in the first position, wherein the release latch is adapted to be engaged to release the battery compartment such that it can swivel to the second position.

* * * * *